US009693162B2

(12) United States Patent
Yu

(10) Patent No.: US 9,693,162 B2
(45) Date of Patent: Jun. 27, 2017

(54) SYSTEM, AUDIO OUTPUT DEVICE, AND METHOD FOR AUTOMATICALLY ADJUSTING FIRING DIRECTION OF UPWARD FIRING SPEAKER

(71) Applicant: AmTRAN TECHNOLOGY CO.,LTD, New Taipei (TW)

(72) Inventor: Yen-Chin Yu, New Taipei (TW)

(73) Assignee: AMTRAN TECHNOLOGY CO., LTD, New Taipei (TW)

( * ) Notice: Subject to any disclaimer, the term of this patent is extended or adjusted under 35 U.S.C. 154(b) by 0 days.

(21) Appl. No.: 15/071,987

(22) Filed: Mar. 16, 2016

(65) Prior Publication Data

US 2017/0156012 A1 Jun. 1, 2017

(30) Foreign Application Priority Data

Nov. 30, 2015 (TW) ..... 104139889 A

(51) Int. Cl.
*H04R 5/02* (2006.01)
*H04R 29/00* (2006.01)
*H04R 3/04* (2006.01)

(52) U.S. Cl.
CPC ..... *H04R 29/001* (2013.01); *H04R 3/04* (2013.01); *H04R 2201/025* (2013.01)

(58) Field of Classification Search
CPC . H04S 7/301; H04S 7/307; H04S 5/02; H04S 2430/01; G06F 3/162
USPC ..... 381/303, 305, 308, 310–311
See application file for complete search history.

(56) References Cited

U.S. PATENT DOCUMENTS

2013/0066453 A1* 3/2013 Seefeldt ..... H04S 7/301 700/94
2016/0330562 A1* 11/2016 Crockett ..... H04S 7/301

* cited by examiner

*Primary Examiner* — Melur Ramakrishnaiah
(74) *Attorney, Agent, or Firm* — Maschoff Brennan

(57) ABSTRACT

A system, an audio output device, and a method for automatically adjusting a firing direction of an upward firing speaker are disclosed. The system includes the audio output device and an audio receiver. The audio output device includes the upward firing speaker. During testing, the device controls the speaker to output a test audio signal at each of multiple testing angles of elevation. The audio receiver within a receiving area receives the test audio signal and generates a received audio waveform for creating reception information. The audio output device selects one testing angle as a preset angle of elevation according to the reception information. At playing, the audio output device is controlled by a mode selection signal and chooses a correction value from a mode lookup table to adjust the preset angle. The speaker is controlled to output an audio signal at the adjusted preset angle.

9 Claims, 5 Drawing Sheets

SYSTEM, AUDIO OUTPUT DEVICE, AND METHOD FOR AUTOMATICALLY ADJUSTING FIRING DIRECTION OF UPWARD FIRING SPEAKER

CROSS REFERENCE

The present application is based on and claims priority from Taiwan Application Serial Number 104,139,889, filed on Nov. 30, 2015, the disclosure of which is hereby incorporated by reference herein in its entirety.

TECHNICAL FIELD

This disclosure relates to a system, an audio output device, and a method for automatically adjusting a firing direction of an upward firing speaker, and particularly to a system, an audio output device and a method for simulating full audio atmosphere.

BACKGROUND

Traditional audio output devices for generating a surround sound effect include arrangements of 5.1 channels, 7.1 channels, 9.1 channels and etc. The setting of these channels may lead to excellent two-dimensional sound effects in a space but can't simulate full audio atmosphere created by a real object moving in a three-dimension space. Currently, except for using conventional surround sound channels, some movie theaters also add channel arrays on ceilings to better present sound contents of movies, so as to improve audiences' telepresence.

However, it's unlikely to equip extra channel arrays on ceilings of ordinary household rooms as in the movie theaters. Instead, via using audio output devices capable of upwardly firing sounds to ceilings, sounds are reflected to audiences, making users sense a three-dimensional sound effect. Nevertheless, each household room has a different environmental condition constructing an audio-visual space, such as volume, height of the audio-visual room or materials of the ceiling. Audio output devices currently available on the market have no way to fit themselves to different household environmental conditions. It turns out that the audio output devices can't demonstrate a default three-dimensional sound effect. That is, when the household environmental condition does not confirm to the environmental condition estimated at the time of designing the audio output devices, the household environmental conditions will diminish the full audio atmosphere.

SUMMARY

In one embodiment of this disclosure, a system for automatically modifying a firing direction of an upward firing speaker is disclosed. The system comprises an audio output device and an audio receiver. The audio output device has at least one upward firing speaker. In a testing procedure, the audio output device controls the upward firing speaker to output at least one test audio signal respectively at each of multiple testing angles of elevation, and selects one among the testing angles of elevation as a preset angle of elevation according to reception information. In a playing procedure, the audio output device is controlled by a mode selection signal to select one among multiple correction values from a mode lookup table, for adjusting the preset angle of elevation so as to control the upward firing speaker to output an audio signal at the adjusted preset angle of elevation. The audio receiver is located in a receiving area for receiving the test audio signal and generates a received audio waveform according to the received test audio signal so as to generate the reception information. The mode lookup table includes multiple correction values corresponding to multiple audio output modes, and the mode selection signal indicates one among the audio output modes.

In another embodiment of this disclosure, an audio output device for automatically adjusting a firing direction comprises an upward firing speaker, a rotating member, a controller and data storage. The upward firing speaker is for outputting an audio signal. The rotating member connects to the upward firing speaker and is controlled by a control signal for adjusting a firing direction of the upward firing speaker. The controller electrically connects to the rotating member for generating the control signal. In a testing procedure, the controller controls the rotating member to adjust the upward firing speaker to output at least one test audio signal at each of multiple testing angles of elevation, and selects one among the testing angles of elevation as a preset angle of elevation according to reception information. In a playing procedure, the controller selects one among multiple correction values defined by a mode lookup table for adjusting the preset angle of elevation, and controls the rotating member to adjust the upward firing speaker for outputting the audio signal at the adjusted preset angle of elevation. The reception information relates to a receiving condition of the test audio signal in a receiving area, and the mode selection signal indicates one among multiple audio output modes. The data storage electrically connects to the controller and is used for storing the mode lookup table defining the correction values corresponding to the audio output modes.

In yet another embodiment of this disclosure, a method for automatically adjusting a firing direction of an upward firing speaker comprises the following steps. In a testing procedure, output by an upward firing speaker at least one test audio signal respectively at each of multiple testing angles of elevation. In the testing procedure, receive the test audio signal by an audio receiver in a receiving area to generate a received audio waveform according to the received test audio signal. Generate reception information according to the received audio waveform. Select one among the testing angles of elevation as a preset angle of elevation according to the reception information. In a playing procedure, select one among multiple correction values from a mode lookup table according to a mode selection signal to adjust the preset angle of elevation, wherein the mode lookup table defines the correction values corresponding to multiple audio output modes, and the mode selection signal indicates one among the audio output modes. In the playing procedure, output an audio signal at the adjusted preset angle of elevation by the upward firing speaker.

According to the above description, the system, audio output device and method for automatically adjusting the firing direction of the upward firing speaker utilize the upward firing speaker to output test audio signals respectively at different testing angles of elevation, which makes the audio receiver at the user's position generate the received audio waveform according to the received test audio signal. The received audio waveform is then passed to the audio output device for determining the preset angle. Thus, at the preset angle, the user may get a better listening feeling, and the full audio atmosphere is prevented from being diminished by different environmental conditions.

In order to make the aforementioned and other features of the present disclosure more comprehensible, several embodiments accompanied with figures are described in detail below.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
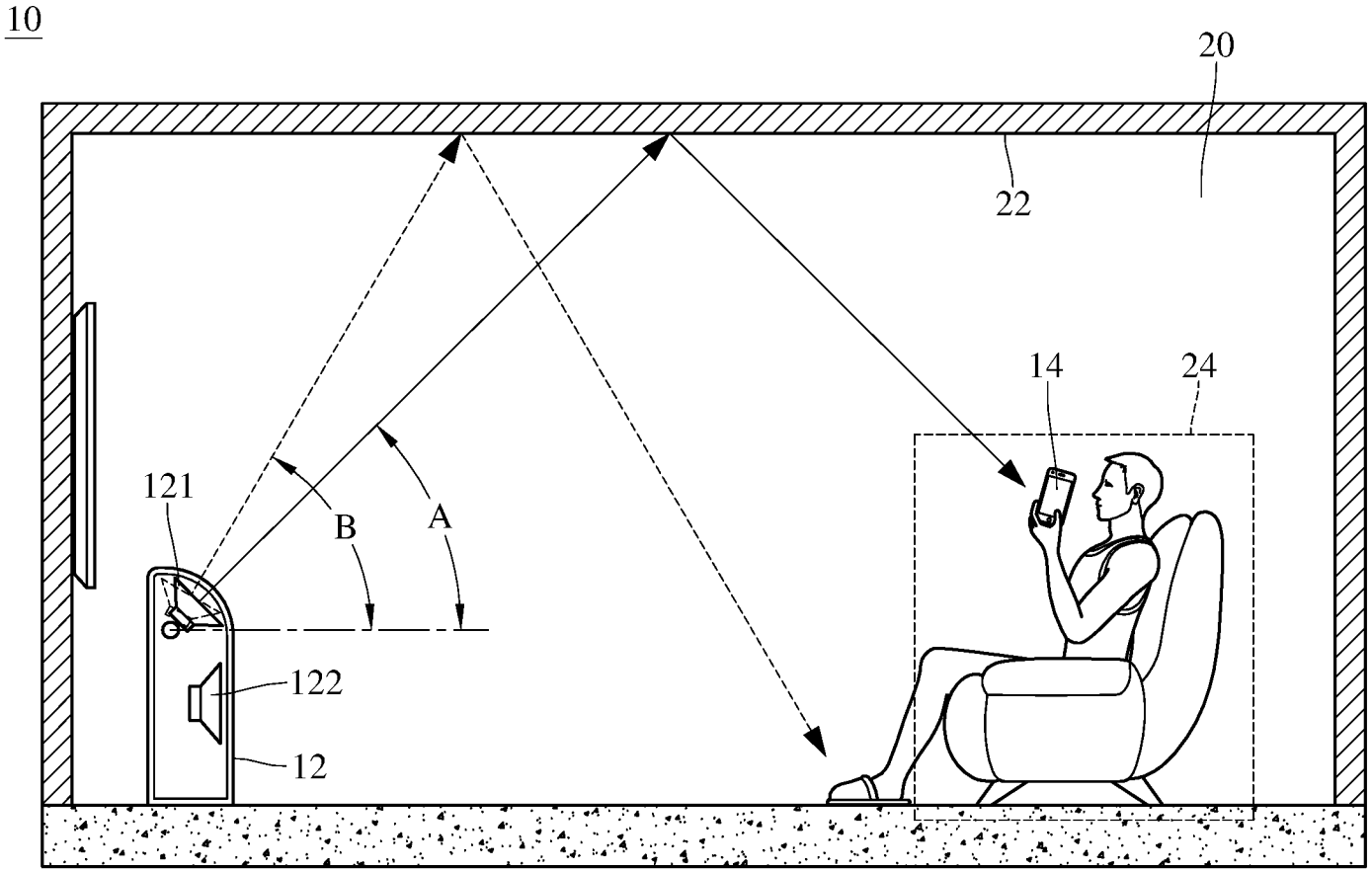
FIG. 1 illustrates a system for automatically adjusting a firing direction of an upward firing speaker according to one embodiment of the disclosure while the system is arranged in an audio-visual space.
Figure 2:
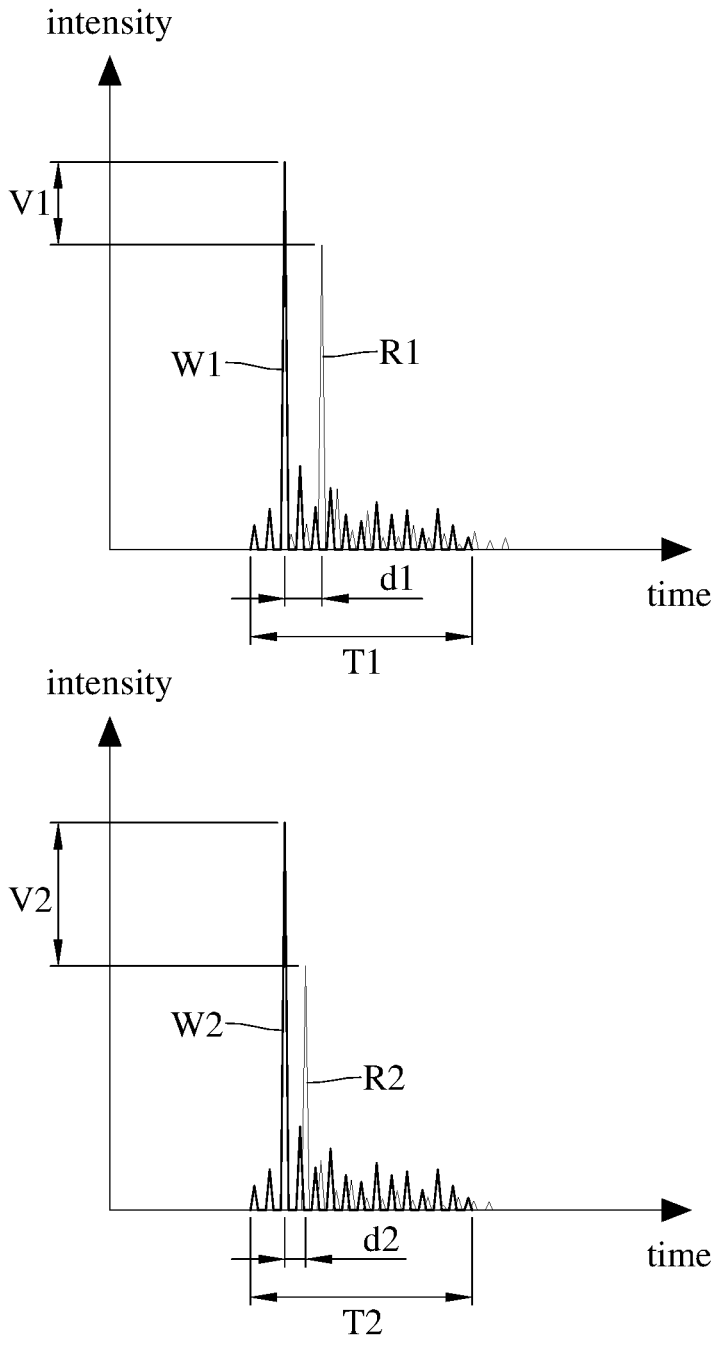
FIG. 2 illustrates diagrams showing waveforms of a test audio signal and a received audio signal according to one embodiment of the disclosure.
Figure 3:
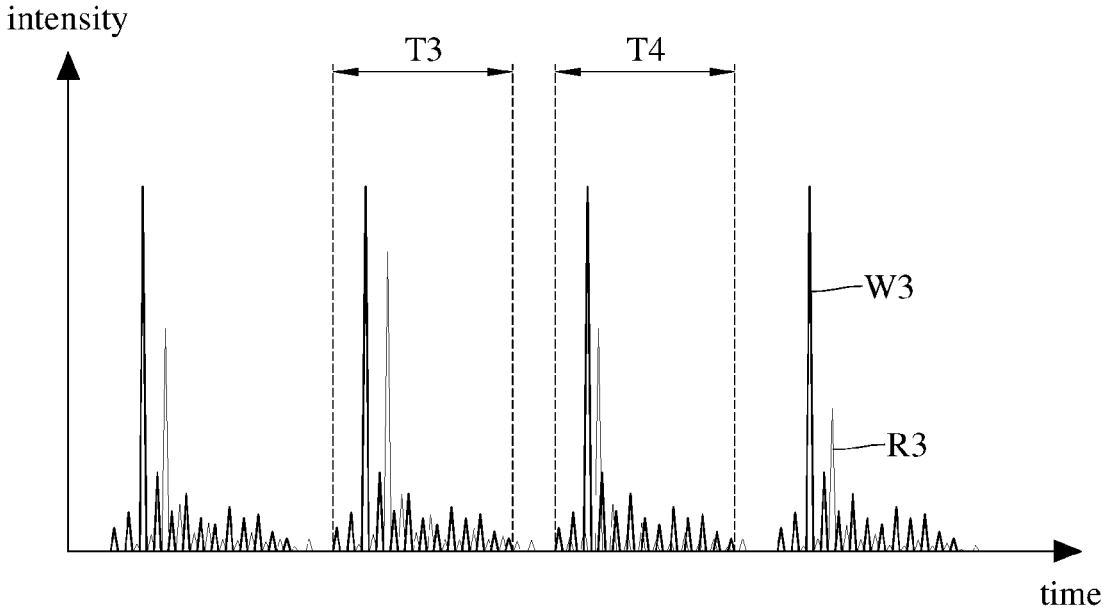
FIG. 3 illustrates a diagram showing waveforms of a test audio signal and a received audio signal according to another embodiment of the disclosure.

Please refer to FIG. 1 through FIG. 3, wherein FIG. 1 illustrates a system for automatically adjusting a firing direction of an upward firing speaker according to one embodiment of the disclosure while the system is arranged in an audio-visual space, FIG. 2 illustrates diagrams showing waveforms of a test audio signal and a received audio signal according to one embodiment of the disclosure, FIG. 3 illustrates a diagram showing waveforms of a test audio signal and a received audio signal according to another embodiment of the disclosure. As shown in FIG. 1, the system 10 includes an audio output device 12 and an audio receiver 14. The audio output device 12 and the audio receiver 14 are arranged in an audio-visual space 20, such as a living room or other adequate spaces in a house. The audio output device 12 includes an upward firing speaker 121 for outputting an audio signal to the ceiling 22 of the audio-visual space 20. The audio signal in the disclosure means a sound wave emitted from the speaker 121 and propagating in air. In one embodiment, the audio output device 12 further includes a horizontal firing speaker 122 for outputting another audio signal horizontally in the audio-visual space, but this disclosure does not intend to limit any embodiment to those recited herein. Moreover, the audio output device 12 can output sounds reproduced from digital or analog signals.

The audio receiver 14, for example, is a remote controller, a smart phone, or other types of devices capable of receiving audio signals. When the audio output device 12 is arranged in the audio-visual space 20 for the first time, the audio output device 12 performs a testing procedure so as to adjust the firing direction of the upward firing speaker 121 adequately. In the testing procedure, the audio receiver 14 is located in a receiving area 24 as shown in FIG. 1, wherein the receiving area 24 is, for example, the location of the audience or the couch in the living room. In one embodiment, the height of the audio receiver 14 may be equal to, but not limited to, the height of the ears of the audience sitting on the couch. Practically, the audio receiver 14 connects the audio output device 12 by a wire or wireless manner.

In one embodiment, the audio output device 12 may be controlled by the audio receiver 14 to perform the testing procedure. For example, if the audio receiver 14 is a smart phone, it can execute an application program for controlling the audio output device 12 and then instructs the audio output device 12 to perform the testing procedure. In another embodiment, the audio output device 12 may be controlled by, for example but not limited to, a trigger button of the audio output device 12 or other audio sources, such as a television, an audio amplifier or other adequate devices.

In the testing procedure, the audio output device 12 controls the upward firing speaker 121 to output a test audio signal respectively at each of a variety of testing angles of elevation. A testing angle of elevation is, for example, the angle between the horizontal direction and the firing direction of the upward firing speaker 121. As shown in FIG. 1, the upward firing speaker 121 outputs the test audio signal at the testing angle of elevation A or B so the audio receiver 14 located in the receiving area 24 can generate a received audio waveform according to the received test audio signal.

For example, as shown in FIG. 2, the upward firing speaker 121 outputs a test audio signal at the testing angle A, i.e. the waveform W1, in the first time period T1. The audio receiver 14 generates the first received audio waveform R1 according to the received audio content during the first time period T1. The upward firing speaker 121 outputs another test audio signal at the testing angle B, i.e. the waveform W2, in the second time period T2. The audio receiver 14 generates the second received audio waveform R2 according to the received audio content during the second time period T2. The test audio signal outputted by the upward firing speaker 121 in the first time period T1 may be identical to or different from that in the second time period T2.

In another embodiment, as shown in FIG. 3, the upward firing speaker 121 constantly changes its testing angle of elevation and outputs a test audio signal, such as the waveform W3 for the audio receiver 14 to generate the received audio waveform R3. For example, the upward firing speaker 121 stays at the testing angle A and outputs a test audio signal during the first time period T3, and then the upward firing speaker 121 is adjusted to stay at the testing angle B for outputting a test audio signal during the second time period T4. The received audio waveform R3 generated by the audio receiver 14 in the receiving area 24 also varies with variation of the testing angle from the first time period T3 to the second time period T4.

In one embodiment, the audio receiver 14 outputs the received audio waveform to the audio output device 12, and the audio output device 12 analyzes the reception information according to the received audio waveform. The reception information is, for example, a sound intensity feature or a transmission delay feature between the test audio signal and the received audio waveform. Taking the embodiment in FIG. 2 as an example, the audio output device 12 compares the intensity of the waveform W1 with the intensity of the first received audio waveform R1 during the first time period T1 to determine the intensity difference V1. And, the audio output device 12 compares the intensity of the waveform W2 with the intensity of the second received audio waveform R2 during the first time period T2 to determine the intensity difference V2. The audio output device 12 takes the intensity differences V1 and V2 as the sound intensity features of the received audio waveform.

Furthermore, the audio output device 12 determines the time difference d1 between the first received audio waveform R1 and the test audio signal W1 according to the comparison made for the first time period T1. The audio output device 12 also determines the time difference d2 between the second received audio waveform R2 and the test audio signal W2 according to the comparison made for the second time period T2. The time differences d1 and d2 are taken as the transmission delay features of the received audio waveform.

In one embodiment, the test audio signal has a characteristic waveform, such as a pulse with specific amplitude or a sine wave having a particular period. According to the time point at which the characteristic waveform starts in the test audio signal, the audio output device 12 can compare with the time point at which the same characteristic waveform appears in the received audio waveform, so as to calculate the time difference between the two waveforms accordingly and take the time difference as the transmission delay feature of the received audio waveform.

Then, the audio output device 12 selects one among the testing angles of elevation as the preset angle of elevation. For example, the output device 12 compares the sound intensity feature of the received waveform in the first time period T1 with that in the second time period T2, and compares the transmission delay feature of the received audio waveform in the first period T1 with that in the second period T2. While the audio output device 12 determines that the transmission delay feature and the sound intensity feature in the first time period T1 more closely meet a prescribed criterion, the audio output device 12 takes the testing angle of elevation A in the first time period T1 as the preset angle of elevation.

The prescribed criterion for the sound intensity feature and the transmission delay feature is decided according to characteristics of the upward firing speaker, the environmental condition of the audio-visual space, or the user's requirements. In this disclosure, the prescribed criterion is not limited to the above implementations. In one embodiment, the prescribed criterion is according to, but not limited to the stronger sound intensity feature or the shorter transmission delay feature.

After the preset angle of elevation is selected by the audio output device 12, the audio output device 12 is controlled by a mode selection signal in a playing procedure to select one among the plurality of correction values in the mode lookup table, so as to adjust the upward firing speaker 121 to output an audio signal at the adjusted preset angle of elevation. The mode lookup defines the correction values separately corresponding to the audio output modes, and the mode selection signal selects one among the audio output modes. For example, the audio output mode may be a movie mode, a standard mode, a game mode, a music mode, and etc. The correction value defined in the mode lookup table for the movie mode is 100%, which makes the three dimensional sound effect optimized. The correction value of the standard mode is 80% for preventing the user from sensing oppression due to the three dimensional sound effect when he/she is watching an art movie. The correction value of the gaming mode is 90% so that the game is accompanied with stereo sounds for creating a better acoustic-optic effect. The correction value of the music mode is 40%, and the purpose of this is to eliminate the reflection channel from the ceiling as much as possible and make the audience have a peaceful sensation. When the mode selection signal controls the audio output device 12 to run in the movie mode, the audio output device 12 adjusts the preset angle of elevation according to the correction value 100% and controls the upward firing speaker 121 to output audio signals fully at the preset angle. In other words, the mode selection signal indicates the movie mode, the upward firing speaker 121 then outputs audio signals at the preset angle of elevation.

The mode selection signal may be generated by another controller such as a controller attached to the audio output device 12, a television, an audio amplifier, or other devices. Taking the television or the audio amplifier as an example, the user may select an audio-visual playing mode through the television or the audio amplifier, and the television or the audio amplifier generates the mode selection signal according to the selected audio-visual playing mode and then transmits the mode selection signal to the audio output device 12. As a result, the audio output device 12 runs the corresponding audio output mode according to the chosen audio-visual playing mode.

In another embodiment, the mode selection signal may be generated by a smart phone which also acts as the audio receiver 14. For clearly reciting the embodiment, the actual operation of the upward firing speaker is elaborated in the following context by taking the smart phone, acting as the audio receiver 14, as an example.

First, the audio output device 12 connects with the smart phone in the receiving area 24 after the audio output device 12 has been installed in the audio-visual space 20. Then, the upward firing speaker 121 of the audio output device 12 outputs a test audio signal at the testing angle of 30 degrees and constantly outputs a test audio signal every time the testing angle shifts 5 degrees until 70 degrees. That is, the upward firing speaker 121 outputs a test audio signal respectively at each of the testing angles 30 degrees, 35 degrees, 40 degrees . . . and so forth.

The smart phone generates the received audio waveform according to the content of the received audio signal and transmits the received audio waveform to the audio output device 12. In terms of the received audio waveform, the audio output device 12 determines that sound the intensity feature and the transmission delay feature of the received audio waveform more closely meet the prescribed criterion when the upward firing speaker 121 outputs a test audio signal at the angle of elevation 50 degrees. Hence, the audio output device 12 selects 50 degrees as the preset angle of elevation. Later in the playing procedure, when the audience instructs the audio output device 12 by the smart phone to run the music mode, the audio output device 12 adjusts the preset angle of elevation according to the correction value 40% of the music mode, so the upward firing speaker 121 outputs the audio signal at the angle equal to 20 degrees, which is 40% of 50 degrees. The correction value is not necessarily a ratio, but can be a difference value as well. For example, as the correction value of the music mode is −20 degrees, the upward firing speaker 121 outputs the audio signal at the angle equal to 30 degrees.

Practically, when the audio output device 12 controls the upward firing speaker 121 to output the audio signal at the adjusted preset angle of elevation, the audio output device 12 further use the transmission delay feature as a basis for adjusting the time of outputting the audio signal. In this embodiment, when the upward firing speaker 121 outputs the audio signal at the angle 20 degrees, the sound propagation distance changes consequently. Hence, the audio output device 12, according to the transmission delay feature as the speaker 121 is at the testing angle 20 degrees, adjusts the time for outputting the audio signal by the upward firing speaker 121. In one embodiment, the adjusted preset angle of elevation is included in the set consisting of all testing angles the audio output device 12 used in the testing procedure. In another embodiment, while the adjusted preset angle of elevation was not tested in the testing procedure, the audio output device 12 may use transmission delay features of testing angles to calculate that of the adjusted preset angle by interpolation or other adequate methods.

In the above embodiment, the reception information is a result determined by the audio output device 12 according to the received audio waveform generated by the audio receiver 14. However, the reception information may be generated by the audio receiver 14 in other embodiments. For example, if the audio receiver 14 is a smart phone, the smart phone can request the audio output device 12 to transmit the waveform of the test audio signal to the smart phone. Hence, the smart phone compares the waveform of the test audio signal with the received audio waveform in the same time period so as to generate and pass the reception information to the audio output device 12. The audio output device 12 then selects the preset angle of elevation according to the reception information. The method for generating the reception information is the same as depicted in the previous embodiment and shall not be repeated here.

Figure 4:
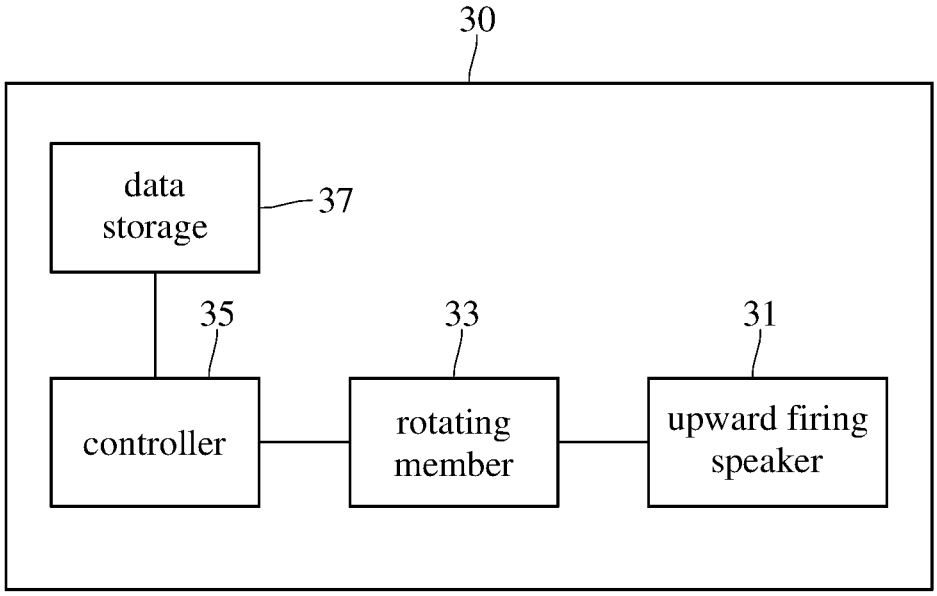
FIG. 4 is a functional block diagram of an audio output device according to yet another embodiment of this disclosure.

Please refer to FIG. 4 which is a functional block diagram of an audio output device according to yet another embodiment of this disclosure. As shown in FIG. 4, the audio output device 30 includes an upward firing speaker 31, a rotating member 33, a controller 35, and data storage 37. The upward firing speaker 31 is used for outputting audio signals. The rotating member 33 is used for bearing the upward firing speaker 31 and controlled by a control signal to adjust a firing direction of the upward firing speaker 31. The controller 35 is electrically coupled to the rotating member 33 and used for generating the control signal to control the rotating member 33. In a testing procedure, the controller 35 controls the rotating member 33 to adjust the upward firing speaker 31 to output a test audio signal at each of multiple testing angles of elevation. Further, based on reception information, the controller 35 chooses one among the testing angles of elevation as a preset angle of elevation.

The reception information relates to the receiving condition of the test audio signal in a receiving area. For example, use a smart phone in the receiving area to detect the test audio signal outputted by the upward firing speaker 31 for generating a received audio waveform accordingly. The smart phone also obtains the waveform of the test audio signal from the audio output device 30 for determining intensity and waveform variations between the test audio signal and the received audio waveform. so as to generate the reception information. The smart phone receives the waveform of the test audio signal from the audio output device 30 is, for example, to receive an audio file or other suitable kinds of files of the test audio signal. In this embodiment, the test audio signal received from the audio output device 30 is not an audio signal detected by an audio receiver in the smart phone, but a file transmitted through a wire or wireless connection between the smart phone and the audio output device 30. In other embodiment, the smart phone may also transfer the received audio waveform to the audio output device 30 via a wire or wireless connection, and the controller 35 of the audio output device 30 generates the reception information by analyzing intensity and waveform variations between the received audio waveform and the test audio signal.

In a playing procedure, the controller 35, according to a mode selection signal, selects a correction value from a mode lookup table for adjusting the preset angle of elevation and controls the rotating member 33 to orientate at the adjusted preset angle of elevation. The mode selection signal indicates an audio output mode. In this embodiment, the mode selection signal is generated by a smart phone or other controllers. In other words, the audio output device 30 can generate the received audio waveform via an audio receiver and selects the audio output mode by a controller. In other embodiments, the audio receiver and the controller may be a single device such as a smart phone, so as to generate the received audio waveform and specify the audio output mode.

The data storage 37 is used for saving the mode lookup table defining the correction values respectively corresponding to the audio output modes. The audio output modes are, for example, a movie mode, a standard mode, a game mode, and a music mode. The correction value defined in the mode lookup table for the movie mode is 100%, the correction of the standard mode is 80%, the correction value of the game mode is 90%, and the correction value of the music mode is 40%.

In yet another embodiment, the mode lookup table may also define a variety of correction values for different users. For example, the users are the father, the mother, and the son in a family, wherein the father's height is 180 centimeters (cm), and the mother's height is 165 cm, and the son's height is 120 cm. The correction value for the father is defined as 100% in the mode lookup table according to the height of father. Similarly, the correction value for the mother is defined as 90%, and the correction value for the son is defined as 70%. In this embodiment, the audio output device 30 is tested by choosing the father's height as a standard when performing the testing procedure, so the correction value for the father is 100%. In this embodiment, the number of the users, the heights, and the correction values are just for simple illustrations, not used to limit the disclosure.

Figure 5:
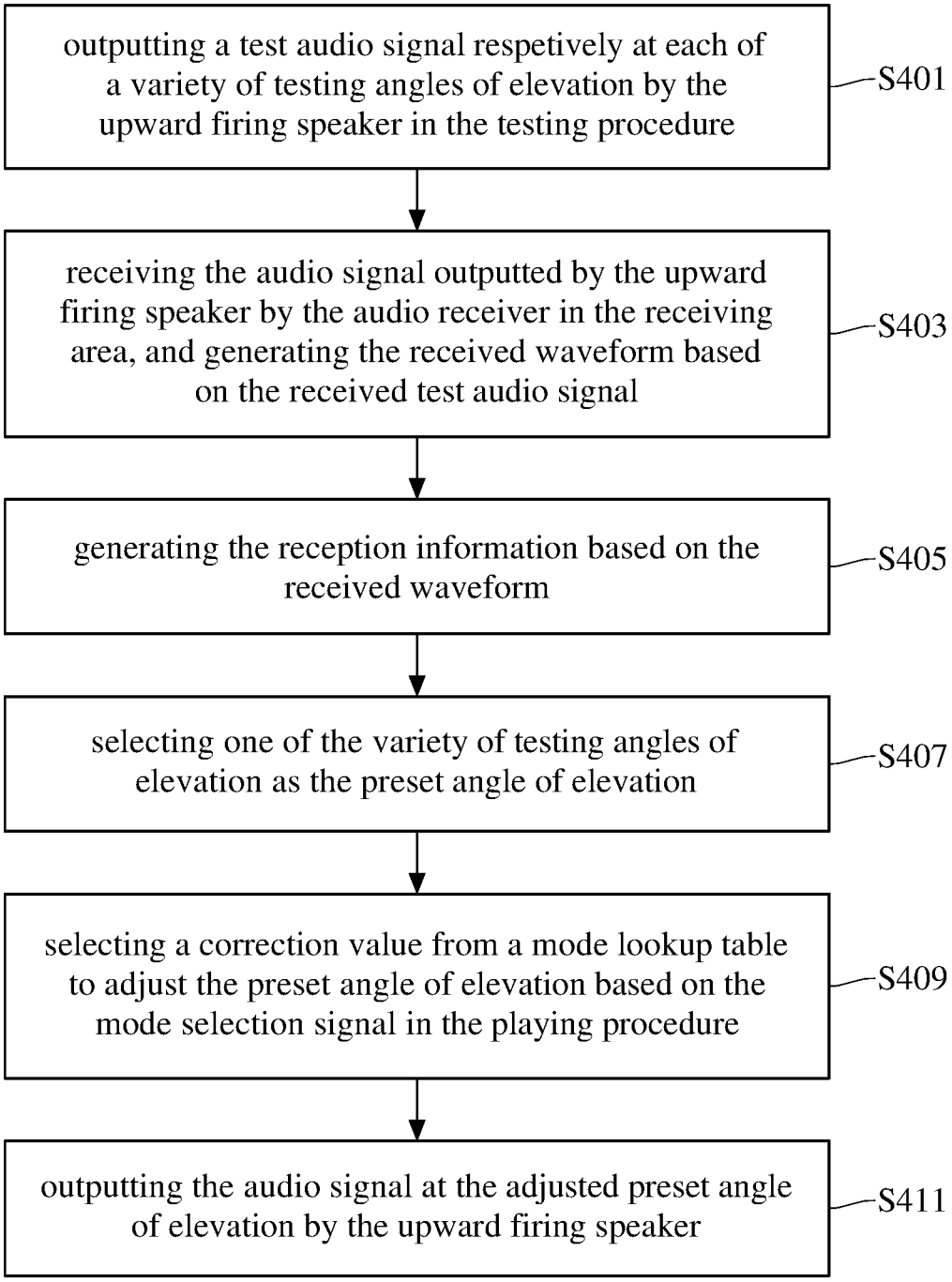
FIG. 5 is a flow chart of a method for automatically adjusting a firing direction of an upward firing speaker according to still yet another embodiment of this disclosure.

To understand the method for automatically adjusting the firing direction of the upward firing speaker in this disclosure, please refer to FIG. 1 along with FIG. 5, wherein FIG. 5 is a flow chart of a method for automatically adjusting a firing direction of an upward firing speaker according to still yet another embodiment of this disclosure. As shown in step S401, a test audio signal is outputted by the upward firing speaker 121 respectively at each of multiple testing angles of elevation in the testing procedure. In step S403, the audio receiver 14 is located in the receiving area 24 and used for receiving the test audio signal outputted by the upward firing speaker 121 in the testing procedure, and generating the received audio waveform according to the received test audio signal. In step S405, the reception information is generated according to the received audio waveform. In step S407, one among the plurality of testing angles of elevation is selected as the preset angle of elevation. In step S409, when the playing procedure is executed, one among the plurality of correction values in the mode lookup table is selected according to the mode selection signal so as to adjust the preset angle of elevation. The correction values of the audio output modes are defined in the mode lookup table, and the mode selection signal indicates one audio output mode. In step S411, the upward firing speaker 121 outputs the audio signal at the adjusted preset angle of elevation in the playing procedure. Details of the method for automatically adjusting the firing direction have been illustrated in the aforementioned embodiments and shall not be repeated here.

To sum up, this disclosure provides a system, an audio output device, and a method for automatically adjusting a firing direction of an upward firing speaker. Through using the upward firing speaker to output a test audio signal at each of multiple testing angles of elevation, an audio receiver at an audience's position can detect the test audio signal and generates reception information. Hence, the audio output device can determine an angle of elevation suitable for an audio-visual space. In this way, the problem that the best full audio atmosphere can't be reached in different environmental conditions is resolved.

Moreover, by adjusting the preset angle of elevation with correction values in a mode lookup table for different audio output modes, the audio output device may provide better full audio atmosphere for the audience. And the audience can get the most adequate sound effects in a variety of situations.

What is claimed is:

1. A system for automatically modifying a firing direction of an upward firing speaker, comprising:

an audio output device having at least one upward firing speaker, controlling the upward firing speaker in a testing procedure to output at least one test audio signal respectively at each of multiple testing angles of elevation, selecting one of the testing angles of elevation as a preset angle of elevation according to reception information, and controlled by a mode selection signal in a playing procedure to select one among multiple correction values defined by a mode lookup table, for adjusting the preset angle of elevation so as to control the upward firing speaker to output an audio signal at the adjusted preset angle of elevation; and an audio receiver, located in a receiving area for receiving the test audio signal in the testing procedure, and generating a received audio waveform according to the received test audio signal to create the reception information;

wherein the correction values correspond to multiple audio output modes, and the mode selection signal indicates one of the audio output modes, wherein the upward firing speaker outputs the test audio signal at one of the testing angles of elevation in each of multiple time periods, and wherein the reception information comprises a sound intensity feature or a transmission delay feature of the received audio waveform in each of the time periods, wherein the sound intensity feature relates to a difference between intensities of the received audio waveform and of the test audio signal, and the transmission delay feature relates to a time difference between the received audio waveform and the test audio signal.

2. The system in claim 1, wherein the mode selection signal is generated by the audio receiver.

3. The system in claim 1, wherein when the audio output device controls the upward firing speaker to orientate at the adjusted preset angle of elevation, the audio output device further adjusts an output time of the audio signal according to the transmission delay feature.

4. An audio output device for automatically adjusting a firing direction, comprising:

an upward firing speaker for outputting an audio signal;

a rotating member for bearing the upward firing speaker, controlled by a control signal to adjust a firing direction of the upward firing speaker;

a controller electrically connected to the rotating member, for generating the control signal to adjust the firing direction, the controller controlling the rotating member in a testing procedure to adjust the upward firing speaker to output at least one test audio signal respectively at each of multiple testing angles of elevation, selecting one of the testing angles of elevation as a preset angle of elevation according to reception information, picking in a playing procedure one among multiple correction values defined by a mode lookup table for adjusting the preset angle of elevation, and controlling the rotating member to adjust the upward firing speaker to output the audio signal at the adjusted preset angle of elevation, the reception information relating to a receiving condition of the test audio signal in a receiving area, the mode selection signal indicating one of the audio output modes; and data storage for storing the mode lookup table which defines the correction values corresponding to audio output modes, wherein the upward firing speaker outputs the test audio signal at one of the testing angles of elevation in each of multiple time periods, and wherein the reception information comprises a sound intensity feature or a transmission delay feature of a received audio waveform, the sound intensity feature relates to a difference between intensities of the received audio waveform and of the test audio signal, and the transmission delay feature relates to a time difference between the received audio waveform and the test audio signal.

5. The audio output device in claim 4, wherein when the audio output device controls the upward firing speaker to output the audio signal at the adjusted preset angle of elevation, the audio output device further adjusts an output time of the audio signal according to the transmission delay feature.

6. The audio output device in claim 4, wherein the mode selection signal is generated by an audio receiver.

7. A method for automatically adjusting a firing direction of an upward firing speaker, comprises:

outputting in a testing procedure by an upward firing speaker at least one test audio signal at each of multiple testing angles of elevation;

receiving in the testing procedure by an audio receiver in a receiving area the test audio signal to generate a received audio waveform according to the received test audio signal;

generating reception information according to the received audio waveform;

selecting one of the testing angles of elevation as a preset angle of elevation according to the reception information;

selecting in a playing procedure one among multiple correction values from a mode lookup table according to a mode selection signal to adjust the preset angle of elevation, the mode lookup table defining the correction values corresponding to multiple audio output modes, the mode selection signal indicating one of the audio output modes; and outputting in the playing mode by the upward firing speaker an audio signal at the adjusted preset angle of elevation, wherein the upward firing speaker outputs the test audio signal at one of the testing angles of elevation in each of multiple time periods, and the step of generating the reception information according to the received audio waveform further comprises generating the reception information according to the received audio waveform generated by the audio receiver in each of the time periods, and wherein the reception information comprises a sound intensity feature or a transmission delay feature of the received audio waveform, the sound intensity feature relates to a difference between intensities of the received audio waveform and of the test audio signal, and the transmission delay feature relates to a time difference between the received audio waveform and the test audio signal.

8. The method in claim 7, wherein the mode selection signal is generated by the audio receiver.

9. The method in claim 7, further comprising:

further adjusting an output time of the audio signal by the audio output device according to the transmission delay feature when the upward firing speaker is orientated at the adjusted preset angle of elevation.

* * * * *